US005654265A

United States Patent [19]

Kuroda et al.

[11] Patent Number: 5,654,265

[45] Date of Patent: Aug. 5, 1997

[54] NONIONIC POWDERY DETERGENT COMPOSITION

[75] Inventors: Mutsumi Kuroda; Yuichi Sakamato; Yoshinori Otani, all of Wakayama, Japan

[73] Assignee: KAO Corporation, Tokyo, Japan

[21] Appl. No.: 453,490

[22] Filed: May 30, 1995

Related U.S. Application Data

[63] Continuation of Ser. No. 28,215, Mar. 9, 1993, abandoned .

[30] Foreign Application Priority Data

Mar. 12, 1992 [JP] Japan ..... 4-053168

[51] Int. Cl.[6] ..... C11D 1/68; C11D 3/08; C11D 3/10

[52] U.S. Cl. ..... 510/507; 510/532; 510/509; 510/466; 510/506; 510/334

[58] Field of Search ..... 252/174.12, 174.14, 252/135, 174.21, 174.25; 510/507, 532, 509, 466, 506, 334

[56] References Cited

U.S. PATENT DOCUMENTS

| | | | |
|---|---|---|---|
| 3,915,878 | 10/1975 | Yueko et al. | 252/89 |
| 4,344,871 | 8/1982 | Allaway et al. | 252/531 |
| 4,462,804 | 7/1984 | Gangwisch et al. | 8/137 |
| 4,652,391 | 3/1987 | Bulk | 252/99 |
| 4,664,839 | 5/1987 | Rieck | 252/135 |
| 4,728,443 | 3/1988 | Rieck et al. | 252/175 |
| 4,820,439 | 4/1989 | Rieck | 252/135 |
| 4,869,843 | 9/1989 | Saito et al. | 252/135 |
| 5,108,646 | 4/1992 | Beerse et al. | 252/174.25 |
| 5,149,455 | 9/1992 | Jacobs et al. | 252/174.13 |
| 5,393,455 | 2/1995 | Poethkow et al. | 252/174.25 |
| 5,427,711 | 6/1995 | Sakaguchi et al. | 252/174.25 |

FOREIGN PATENT DOCUMENTS

| | | |
|---|---|---|
| 0477947 | 1/1992 | European Pat. Off. . |
| 0477974 | 1/1992 | European Pat. Off. . |
| 4228044 | 3/1994 | Germany . |
| 4339898 | 11/1992 | Japan . |
| 9000189 | 11/1990 | WIPO . |
| 9109101 | 6/1991 | WIPO . |
| 9405764 | 3/1992 | WIPO . |
| 9207928 | 5/1992 | WIPO . |
| 9218594 | 10/1992 | WIPO . |

*Primary Examiner*—Douglas J. McGinty
*Assistant Examiner*—Kery A. Fries

[57] ABSTRACT

A nonionic powdery detergent composition which is free from bleeding of a nonionic surfactant, does not exhibit any deterioration in its solubility even after the passage of time and has an excellent detergency against a fatty acid soil, which comprises 12 to 50% by weight of (a) a nonionic surfactant having a melting point of 40° C. or below, 3 to 60% by weight of (b) a specified crystalline layer silicate, and 5 to 30% by weight of (c) a porous oil-absorbent carrier having an oil absorbability of 80 ml/100 g or more, and a process for producing the nonionic powdery detergent composition.

18 Claims, No Drawings

NONIONIC POWDERY DETERGENT COMPOSITION

This application is a continuation of application Ser. No. 08/028,215 filed on Mar. 9, 1993, now abandoned.

BACKGROUND OF THE INVENTION

1. Field of the Invention

The present invention relates to a powdery detergent composition comprising a nonionic surfactant as a main base, and more particularly to a powdery detergent composition which is free from bleeding of the nonionic surfactant, does not exhibit any deterioration in its solubility during storage and has an improved detergency against a fatty acid soil.

2. Description of the Related Art

A nonionic surfactant has various features such as good hard water resistance and, at the same time, prominent detergency and capability of dispersing soil, and further very excellent biodegradability, so that it is deemed to be an important surfactant for washing.

However, since many nonionic surfactants used for washing purposes are usually liquid at ordinary temperatures, a powdery detergent composition containing a liquid nonionic surfactant in a large amount has the problem that the nonionic surfactant gradually bleeds out from the powdery detergent composition with the passage of time and penetrates into the inside of the paper container which holds the powdery detergent composition or the powdery detergent composition brings about massive caking, which adversely effects the commercial value of the powdery detergent composition.

U.S. Pat. No. 4,138,051 (published on Jan. 23, 1979, Assignee: Henkel KGaA) discloses a detergent composition having an improved fluidity and comprising a premixture composed of a crystalline or amorphous aluminosiligate having an ion exchange capacity of 50 mg CaO/g (89 mg $CaCO_3$/g) or more (4% or less of a highly dispersive silica may be used as an oil-absorbent carrier), a nonionic surfactant and optionally aft inorganic peroxide capable of forming hydrogen peroxide in water and, incorporated into the premixture, a spray-dried detergent. Great Britain Patent No. 1474856 (published on May 5, 1977) discloses a detergent composition having an improved fluidity and comprising a mixture of a synthetic amorphous silica derivative (including an aluminosilicate) having an oil absorbability of 50 to 200 $cm^3$/100 g with a nonionic surfactant.

Thus the methods of improving the properties of a powder of a nonionic powdery detergent composition are known in the art. In the above-described prior art methods, however, since a water-insoluble carrier, such as silica, is used for the purpose of preventing the nonionic surfactant from bleeding and, at the same time, zeolite is incorporated therein for the purpose of improving detergency, the incorporation of an alkali builder is causative of a remarkable deterioration in the solubility of the nonionic powdery detergent composition after storage under high humidity conditions. This is believed to be because the alkali builder, which is a water-soluble silicate, serves as a binder for a water-insoluble substance such as silica or zeolite. Replacement of the zeolite with a phosphorus builder, such as sodium tripolyphosphate, is considered as a means for eliminating the above-described problem. This method, however, is not necessarily favorable from the viewpoint of environmental issue.

For this reason, in a zeolite-containing detergent composition, the amount of addition of a silicate builder such as JIS No. 1 sodium silicate is reduced to cope with the problem. However, the reaction in the amount of incorporation of the silicate builder leads to a lowering in the detergency, so that an improvement in the detergency is desired in the art. In fact, the above-described conventional detergent compositions have not always been useful for removing a fatty acid soil amounting to 10 to 20% of the dirt from the neck of cloths.

Further, WO 90/00189 (published on Jan. 11, 1990) discloses a granular detergent composition produced by homogeneously mixing a porous silicate derivative such as zeolite, bentonire and layer silicate with a water-soluble or water-dispersive nonionic surfactant in such a proportion that the porous silicate derivative content is 30% by weight or more. The layer silicate described in WO 90/00189, however, has a low ion exchange capacity. Further, the granular detergent composition has the problem of retaining solubility after storage for a long period of time and is unsatisfactory in the detergency as well.

DISCLOSURE OF THE INVENTION

SUMMARY OF THE INVENTION

Under the above-described circumstances, the present inventors have made extensive studies on a powdery detergent composition for cloths, comprising a nonionic surfactant as a main base for the detergent composition and, as a result, have found that the use of a crystalline layer silicate having specified properties and a porous oil-absorbent carrier having specified properties, can provide a detergent composition which is excellent in not only the prevention of bleeding of the nonionic surfactant but also the solubility thereof, has an improved detergency and is particularly effective in removing a fatty acid soil. The present invention is completed on the basis of this finding.

Accordingly, the present invention provides a nonionic powdery detergent composition comprising 12 to 50% by weight, based on the total weight of the composition, of (a) a nonionic surfactant having a melting point of 40° C. or below, 8 to 60% by weight, based on the total weight of the composition, of (b) a crystalline layer silicate represented by the formula (I) and 5 to 30% by weight, based on the total weight of the composition, of (c) a porous oil-absorbent carrier having an oil absorbability of 80 ml/100 g or more:

$$M_2Si_xO_{(2x+1)}\cdot y(H_2O) \qquad (I)$$

wherein M represents an alkali metal atom and x and y are respectively $1.5 \leqq x \leqq 4$ and $y \leqq 25$, that is $0 < y \leqq 25$.

The above-described nonionic powdery detergent composition also includes one comprising 15 to 45% by weight, based on the total weight of the composition, of (a) a nonionic surfactant having a melting point of 40° C. or below, 5 to 30% by weight, based on the total weight of the composition, of (b) a crystalline layer silicate represented by the formula (I), 10 to 30% by weight, based on the total weight of the composition, of (c') an amorphous aluminosilicate having an oil absorbability of 100 ml/100 g or more and represented by the formula (3) and 10 to 30% by weight, based on the total weight of the composition, of (e) a synthetic crystalline aluminosilicate, with the proviso that the total content of the nonionic surfactant (a), the crystalline layer silicate (b), the amorphous aluminosilicate (c') and the synthetic crystalline aluminosilicate (e) is 75% by weight or more based on the total weight of the composition, the total content of the amorphous aluminosilicate (c') and the synthetic crystalline aluminosilicate (e) is 20 to 50% by weight based on the total weight of the composition:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$, that is $0 < y \leqq 25$; and $$a'(M_2O)\cdot d'(MeO)\cdot Al_2O_3\cdot b'(SiO_2)\cdot c'(H_2O) \quad (3)$$

wherein M represents an alkali metal atom, Me represents an alkaline earth metal atom, a', b', c' and d' each represent the number of moles of the respective component, and wherein $0.2 \leqq a' \leqq 2.0$, $1.5 \leqq b' \leqq 8.0$, $0 \leqq d' \leqq 0.1$ and c' represents an arbitrary positive number.

This nonionic powdery detergent composition composition can also contain an amorphous alkali metal silicate in an amount of 5% by weight or less based on the total weight of the composition and an alkali metal carbonate in an amount of 15% by weight or less based on the total weight of the composition.

The present invention also provides a nonionic powdery detergent composition comprising 12 to 50% by weight, based on the total weight of the composition, of (a) a nonionic surfactant having a melting point of 40° C. or below, 3 to 60% by weight, based on the total weight of the composition, of (b) a crystalline layer silicate represented by the formula (I), 5 to 30% by weight, based on the total weight of the composition, of (c) a porous oil-absorbent carrier having an oil absorbability of 80 ml/100 g or more and 1 to 5% by weight, based on the total weight of the composition, of (d) a polyethylene glycol having a weight average molecular weight of 4000 to 20000:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$, that is $0 < y \leqq 25$.

The above-described nonionic powdery detergent composition also includes one comprising 15 to 45% by weight, based on the total weight of the composition, of (a) a nonionic surfactant having a melting point of 40° C. or below, 5 to 30% by weight, based on the total weight of the composition, of (b) a crystalline layer silicate represented by the formula (I), 10 to 30% by weight, based on the total weight of the composition, of (c') an amorphous aluminosilicate having an oil absorbability of 100 ml/100 g or more and represented by the formula (3), 1 to 5% by weight, based on the total weight of the composition, of (d) a polyethylene glycol having a weight average molecular weight of 4000 to 20000 and 10 to 30% by weight, based on the total weight of the composition, of (e) a synthetic crystalline aluminosilicate, with the proviso that the total content of the nonionic surfactant (a), the crystalline layer silicate (b), the amorphous aluminosilicate (c') and the synthetic crystalline aluminosilicate (e) is 75% by weight or more based on the total weight of the composition, the total content of the amorphous aluminosilicate (c') and the synthetic crystalline aluminosilicate (e) is 20 to 50% by weight based on the total weight of the composition:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$, that is $0 < y \leqq 25$; and $$a'(M_2O)\cdot d'(MeO)\cdot Al_2O_3\cdot b'(SiO_2)\cdot c'(H_2O) \quad (3)$$

wherein M represents an alkali metal atom, Me represents an alkaline earth metal atom, a', b', c' and d' each represent the number of moles of the respective component, and wherein $0.2 \leqq a' \leqq 2.0$, $1.5 \leqq b' \leqq 8.0$, $0 \leqq d' \leqq 0.1$ and c' represents an arbitrary positive number.

This nonionic powdery detergent composition can also contain an amorphous alkali metal silicate in an amount of 5% by weight or less based on the total weight of the composition and an alkali metal carbonate in an amount of 15% by weight or less based on the total weight of the composition.

In the above-described nonionic powdery detergent compositions, the amounts of the nonionic surfactant (a) and the porous oil-absorbent carrier (c) are advantageously 12 to 35% by weight based on the total weight of the composition and 5 to 20% by weight based on the total weight of the composition, respectively.

The present invention further provides a process for producing a nonionic powdery detergent composition which comprises gradually adding or spraying under stirring 12 to 50% by weight based on the total weight of the composition of (a) a nonionic surfactant having a melting point of 40° C. or below onto a mixture of powdery components comprising 3 to 60% by weight based on the total weight of the composition of (b) a crystalline layer silicate represented by the formula (I) and 5 to 30% by weight based on the total weight of the composition of (c) a porous oil-absorbent carrier having an oil absorbability of 80 ml/100 g or more to produce a homogeneous mixture:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$, that is $0 < y \leqq 25$.

Furthermore, the present invention provides a process for producing a nonionic powdery detergent composition which comprises gradually adding or spraying under stirring 12 to 50% by weight based on the total weight of the composition of (a) a nonionic surfactant having a melting point of 40° C. or below onto a mixture of powdery components comprising 3 to 60% by weight based on the total weight of the composition of (b) a crystalline layer silicate represented by the formula (I) and 5 to 30% by weight based on the total weight of the composition of (c) a porous oil-absorbent carrier having an oil absorbability of 80 ml/100 g or more to produce a homogeneous mixture, and adding 1 to 5% by weight based on the total weight of the composition of (d) a polyethylene glycol having a weight average molecular weight of 4000 to 20000 in a molten state to the homogeneous mixture to produce a base for the nonionic powdery detergent composition:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$, that is $0 < y \leqq 25$.

In the above-described processes, the nonionic powdery detergent composition further contains, preferably, a carbonate and the mixture of powdery components preferably comprises the crystalline layer silicate (b), the porous oil-absorbent carrier (c) and the carbonate.

In the above-described processes, the nonionic powdery detergent composition further contains, preferably, an optional component and the process further comprises, preferably, mixing the homogeneous mixture with a detergent assistant or an additive as an optional component.

The optional component is preferably at least one member selected from the group consisting of a powder of a surface modifier, a perfume and an enzyme.

Further scope and the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The nonionic surfactant (a) to be used in the present invention is a liquid or a slurry at 40° C. Namely, the nonionic surfactant (a) has a melting point of 40° C. or below and, therefore, is excellent in soil removal, foaming and foam breaking.

Specific examples of the nonionic surfactant (a) include a polyoxyethylene alkyl ether, a polyoxyethylene alkylphenyl ether, a polyoxyethylene sorbitan/fatty acid ester, a polyoxyethylene sorbitol/fatty acid ester, a polyethylene glycol/fatty acid ester, a polyoxyethylene polyoxypropylene alkyl ether, a polyoxyethylene alkylamine, a glycerin/fatty acid ester, a higher fatty acid alkanolamide, an alkylglycoside and an alkylamine oxide.

Among them, a polyoxyethylene alkyl ether comprising a straight-chain or branched, primary or secondary alcohol having 10 to 20 carbon atoms, preferably 10 to 15 carbon atoms and particularly preferably 12 to 14 carbon atoms and ethylene oxide added thereto in such a manner that the average number of moles of addition thereof is 5 to 15, preferably 6 to 12 and still preferably 6 to 10, is preferably used as a main nonionic surfactant.

In general, the polyoxyethylene alkyl ether contains a large amount of an adduct of an alkyl ether with ethylene oxide wherein the number of moles of addition of ethylene oxide is small. It is preferred to use a polyoxyethylene alkyl ether wherein the content of an adduct having the number of moles of addition of ethylene oxide of 0 to 3 is 35% by weight or less, preferably 25% by weight or less.

The nonionic powdery detergent composition according to the present invention contains the nonionic surfactant (a) in an amount of 12 to 50% by weight, preferably 12 to 35% by weight, and still preferably 15 to 30% by weight based on the total weight of the composition.

The crystalline layer silicate (b) of the present invention is one represented by the formula (I) described above, and preferably one wherein x and y satisfy the requirement that $1.5 \leqq x \leqq 3$ and $0 < y \leqq 5$, respectively. As the crystalline layer silicate (b) of the present invention, one having a cation exchange capacity in the range of from 100 to 400 mg $CaCO_3$/g is usable.

The cationic exchange capacity is measured by the following method.

At the outset, 0.1 g of a sample is weighed and dispersed in 100 ml of an aqueous solution of 500 ppm, as $CaCO_3$, of $CaCl_2$. After the dispersion is stirred at 25° C. for 10 minutes, it is rapidly filtered (through a 0.2-μm filter). 50 ml of deionized water is added to 10 ml of the filtrate. 1 ml of a 20 wt. % aqueous KOH solution is added thereto and, after a few drops of an NN indicator (a 2-hydroxy-1-(2-hydroxy-4-sulfo-1 -naphthylazo)-3-naphthioic acid solution in methanol) is added thereto, the solution is titrated with 0.01M-EDTA. After the titration, the cation exchange capacity is determined from a difference between the titer and the blank.

The nonionic powdery detergent composition according to the present invention contains the crystalline layer silicate (b) in an amount of 3 to 60% by weight, preferably 5 to 40% by weight, and particularly preferably 20 to 40% by weight based on the total weight of the composition.

U.S. Pat. No. 4,664,839 describes a process for producing the crystalline layer silicate (b), and the crystalline layer silicate (b) is generally produced by baking an amorphous vitreous sodium silicate at 200° to 1000° C. to render the sodium silicate crystalline. The synthetic process is described in detail in, for example, Phys. Chem. Glasses., 7. 127–138 (1966) and Z. Kristallogr., 129, 396–404 (1969). The crystalline layer silicate (b) is available in particulate, powdery and granular forms, for example, from Hoechst under the trade name of "Na-SKS-6" ($\delta$-$Na_2Si_2O_5$). In the present invention, use may be made of a crystalline layer silicate (b) having a particle diameter in the range of from 10 to 500 μm, preferably in the range of from 10 to 300 μm.

Though WO90/00189 (published on Jan. 11, 1990) discloses a layer silicate, the layer silicate has a low ion-exchange capacity and is different from the crystalline layer silicate (b) according to the present invention. Detergent compositions wherein a crystalline layer silicate is incorporated are disclosed in Japanese Patent Publication-A Nos. 178398/1990 (published on Jul. 11, 1990) and 178399/1990 (published on Jul. 11, 1990) and U.S. Pat. No. 4,728,443 (published on Mar. 1, 1988, Assignee: Hoechst AG). All of these detergent compositions mainly comprise an anionic surfactant, and no study has been made on a detergent composition comprising a nonionic surfactant as a main base for the detergent composition.

The porous oil-absorbent carrier (c) in the present invention is a carrier having an oil absorbability of 80 ml/100 g or more, preferably 150 ml/100 g or more, still preferably 200 ml/100 g or more and most preferably 200 to 800 ml/100 g. The oil absorbability is a value measured according to JIS K 6220.

The porous oil-absorbent carrier (c) is particularly preferably a silica derivative containing silicon in an amount, calculated as $SiO_2$, of 30% by weight or more and preferably 40% by weight or more, as determined with no hydrate present. Namely, the content of silicon in the porous oil-absorbent carrier (c) is represented by a value calculated as $SiO_2$.

Examples of the above-described silica derivative include amorphous silica and amorphous alumino-silicates. Amorphous silica or amorphous alumino-silicates having a mean particle diameter up to about 200 μm are commercially available under the trade name of Tokusil (manufactured by Tokuyama Soda Co., Ltd.), Nipsil (manufactured by Nippon Silica Industrial Co., Ltd.) and Tixolex (manufactured by Kofran Chemical Co., Ltd.). In the present invention, the porous oil-absorbent carrier (c) can be selected from these commercially available ones.

Among these silica derivatives, a porous oil-absorbent carrier having a pH value of 9 or greater in the form of a carrier dispersion in water (5 g of dispersoid in 100 ml of water) contributes to the further inhibition of the deterioration of the solubility of the detergent composition during storage under high-humidity conditions. Examples of such a porous oil-absorbent carrier include Tokusil AL-1 (manufactured by Tokuyama Soda Co., Ltd.), Nipsil NA (manufactured by Nippon Silica Industrial Co., Ltd.), Carplex #100 (manufactured by Shionogi Pharmaceutical Co., Ltd.) and Sipernat D10 (manufactured by DEGUSSA). Examples of the oil-absorbent amorphous alumino-silicate include an oil-absorbent carrier commercially available under the trademark of Tixolex 25 (manufactured by Kofran Chemical Co., Ltd.). The oil-absorbent carrier capable of satisfying the above-described requirements can be found also in substances having a three dimentional structure and derived from a natural mineral, and examples thereof include "Na-Mordenite HSZ-640 NAA" manufactured by Tosoh Corporation.

A clayey substance such as smectites, which is one of the natural minerals, has a two dimentional structure, and thus causes the deterioration in the solubility of the detergent composition when it is incorporated into the detergent composition. Therefore, use of such a clayey substance in the present invention is unfavorable.

The above-described commercially available oil-absorbent carriers have scarcely any cation exchange capacity. An oil-absorbent carrier having a cation exchange capacity is advantageous because it serves also as a builder for the detergent. Examples of the oil-absorbent carrier having a high oil absorbability and a high cation exchange capacity include oil-absorbent amorphous aluminosilicates represented by the formula (1):

$$a(M_2O)\cdot Al_2O_3\cdot b(SiO_2)\cdot c(H_2)) \quad (1)$$

wherein M represents an alkali metal atom and a, b and c each represent the number of moles of the respective component, wherein generally $0.7 \leqq a \leqq 2.0$, $0.8 \leqq b < 4$ and c represents an arbitrary positive number.

Oil-absorbent amorphous aluminosilicates represented by the formula (2) are particularly preferred:

$$Na_2O\cdot Al_2O_3\cdot b(SiO_2)\cdot c(H_2O) \quad (2)$$

wherein b is 1.8 to 3.2 and c is 1 to 6.

The above-descried amorphous aluminosilicate having a high oil absorbability and a high ion exchange capacity which may be used in the present invention may be produced as follows.

An alkalescent aqueous solution of an alkali metal aluminate having a molar ratio of $M_2O$ (wherein M represents an alkali metal atom) to $Al_2O_3$ of 1.0 to 2.0 and a molar ratio of $H_2O$ to $M_2O$ of 6.0 to 500 is added at a temperature of 15° to 60° C., preferably 30° to 50° C., under vigorous stirring to an aqueous solution of an alkali metal silicate having a molar ratio of $SiO_2$ to $M_2O$ of 1.0 to 4.0 and a molar ratio of $H_2O$ to $M_2O$ of 12 to 200. Alternatively, the aqueous solution of an alkali metal silicate may be added to the alkalescent aqueous solution of an alkali metal aluminate. Then, the formed white precipitate slurry is heat-treated at a temperature of 70° to 100° C., preferably 90° to 100° C. for 10 minutes to 10 hours, preferably 10 minutes to 5 hours, and then filtered. The precipitate on the filter was washed and dried to provide a product. According to the above-described method, an amorphous aluminosilicate oil-absorbent carrier having an ion exchange capacity of 100 $CaCO_3$ mg/g or more and an oil absorbability of 200 ml/100 g or more and preferably 200 to 800 ml/100 g, can be easily produced.

The pH value of the dispersion containing 5% by weight of the porous oil-absorbent carrier is measured according to JIS K 6220. Namely, about 5 g of a sample is weighed into a hard conical flask, and 100 ml of water free from carbonic acid (carbon dioxide) is added thereto. The conical flask is stoppered and then is shaken for 5 min. After shaking, a pH value of the resultant dispersion is measured according to the glass electrode method (see 7.2.3 of JIS Z 8802).

A nonionic powdery detergent composition which does not exhibit any deterioration in its solubility even when stored under high-humidity conditions can be produced through the selection of an oil-absorbent carrier having a pH value of the 5% by weight dispersion thereof of 9.0 or greater.

In some oil-absorbent carriers, although the pH value of a 5% dispersion thereof is below 9.0, the amount of dissolution thereof in a 2% aqueous NaOH solution is 0.5 g or less. Specifically, the oil-absorbent carrier is one wherein the amount of dissolution of the oil-absorbent carrier is 0.5 g or less as measured according to the method which comprises dispersing 10 g of the oil-absorbent carrier in 100 ml of a 2% aqueous NaOH solution, stirring the dispersion at a constant temperature of 25° C. for 16 hours and determining the $SiO_2$ content of the filtrate by colorimetry (Regarding the colorimetry, reference may be made to "Yukagaku", vol. 25, p. 156, 1976). The oil-absorbent carriers of this type as well fall within the scope of the present invention. For example, "Perlite 4159 (manufactured by Dicalite Orient Co., Ltd.)" which is a substance having a three dimentional structure and derived from a natural mineral exhibits the above-described properties and can be used as the oil-absorbent carrier (c) in the present invention.

When the alkalinity of the detergent composition is very high, that is, the aqueous solution of the detergent composition exhibits a high pH value, or the detergent composition is stored under very severe conditions, it is preferred to select an oil-absorbent carrier capable of satisfying more strict requirements that the pH value of the 5% by weight dispersion thereof is 9.0 or greater and that the amount of dissolution thereof in 100 ml of a 2% aqueous NaOH solution is 0.5 g or less. Examples of such an oil-absorbent carrier which can satisfies the above-described requirements include "Na-Mordenite HSZ-640 NAA" manufactured by Tosoh Corporation and can be found also in amorphous aluminosilicates represented by the above formula (2).

The nonionic powdery detergent composition according to the present invention contains the porous oil-absorbent carrier (c) in an amount of 5 to 30% by weight, preferably 5 to 25% by weight, and still preferably 5 to 20% by weight based on the total weight of the composition.

The nonionic powdery detergent composition according to the present invention may contain (d) a polyethylene glycol having a weight average molecular weight of 4000 to 20000 in an amount of 1 to 5% by weight, preferably 1 to 3% by weight. When the nonionic powdery detergent composition contains the polyethylene glycol (d), the properties of the detergent powder during storage for a long period of time can be further improved.

In the composition of the present invention, it is preferred to use a carbonate, particularly an alkali metal carbonate such as sodium carbonate, as an water soluble alkaline salt. Examples of the sodium carbonate include heavy sodium carbonate (heavy ash) and light sodium carbonate (light ash), and the average particle diameter thereof is 10 to 2000 μm, preferably 100 to 1000 μm.

In order to further improve the fluidity of the product, it is possible to incorporate a synthetic crystalline aluminosilicate (e) into the composition of the present invention. In this case, the amount of incorporation thereof is preferably less than 10% by weight based on the total weight of the composition.

When the synthetic crystalline aluminosilicate (e) is incorporated in an amount of 10% by weight or more into the composition of the present invention, it is preferable that the nonionic powdery detergent composition of the present invention will have the following composition.

Namely, it is a nonionic powdery detergent composition comprising 15 to 45% by weight, based on the total weight of the composition, of (a) a nonionic surfactant having a melting point of 40° C. or below, 5 to 30% by weight, based on the total weight of the composition, of (b) a crystalline layer silicate represented by the formula (I), 10 to 30% by weight, based on the total weight of the composition, of (c') an amorphous aluminosilicate having an oil absorbability of 100 ml/100 g or more and represented by the formula (3) and 10 to 30% by weight, based on the total weight of the composition, of (e) a synthetic crystalline aluminosilicate, with the proviso that the total content of the nonionic surfactant (a), the crystalline layer silicate (b), the amorphous aluminosilicate (c') and the synthetic crystalline aluminosilicate (e) is 75% by weight or more based on the total weight of the composition, the total content of the amorphous aluminosilicate (c') and the synthetic crystalline aluminosilicate (e) is 20 to 50% by weight based on the total weight of the composition, the content of the amorphous alkali metal silicate is 5% by weight or less based on the total weight of the composition and the content of the alkali metal carbonate is 15% by weight or less based on the total weight of the composition:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$, that is $0 < y \leqq 25$; and $$a'(M_2O)\cdot d'(MeO)\cdot Al_2O_3\cdot b'(SiO_2)\cdot c'(H_2O) \quad (3)$$

wherein M represents an alkali metal atom, Me represents an alkaline earth metal atom, a', b', c' and d' each represent the number of moles of the respective component, and wherein $0.2 \leqq a' \leqq 2.0$, $1.5 \leqq b' \leqq 8.0$, $0 \leqq d' \leqq 0.1$ and c' represents an arbitrary positive number.

The above-described nonionic powdery detergent composition may contain (d) a polyethylene glycol having a weight average molecular weight of 4000 to 20000 which is present in an amount of 1 to 5% by weight, preferably 1 to 3% by weight based on the total weight of the composition.

The amorphous aluminosilicate (c') is preferably prepared by allowing at least one acid agent selected from the group consisting of an inorganic acid, an organic acid and an acid salt to exist in a reaction system during a reaction of an alkali metal aluminate with an alkali metal silicate in the production of the amorphous aluminosilicate and allowing the reaction to proceed with the pH value of the reaction system being adjusted to 8 to 14.

The synthetic crystalline aluminosilicate (e) is one generally called zeolite and represented by the formula (10):

$$l(M_2O)\cdot Al_2O_3\cdot m(SiO_2)\cdot n(H_2O) \quad (10)$$

wherein M represents an alkali metal atom, l, m and n each represent the number of moles of the respective component, wherein generally $0.7 \leqq l \leqq 1.5$, $0.8 \leqq m < 6$ and n represents an arbitrary positive number.

Among them, a synthetic crystalline aluminosilicate represented by the formula (11) is preferred:

$$Na_2O\cdot Al_2O_3\cdot m'(SiO_2)\cdot n'(H_2O) \quad (11)$$

wherein m' is 1.8 to 3.0 and n' is a number of 1 to 6.

Preferred examples of the crystalline aluminosilicate (e) include synthetic zeolites having an average primary particle diameter of 0.1 to 10 μm including types A and X zeolites. The zeolite is incorporated in the form of a powder and/or particles which are prepared by drying and aggregating a zeolite slurry.

The amorphous alkali metal silicate which can be present in the detergent composition according to the present invention is one having a $SiO_2/M_2O$ (wherein M represents an alkali metal atom, e.g., sodium and/or potassium) ratio of from 0.5 to 4.0, and is generally incorporated into the detergent composition as an water soluble alkaline salt or used as a corrosion inhibitor for a metal. In the above-described nonionic powdery detergent composition, the content of the amorphous alkali metal silicate is less than 5% by weight, preferably 1% by weight or less based on the total weight of the composition. When the content of the amorphous alkali metal silicate is 5% by weight or more, the solubility of the detergent composition tends to be remarkably lower.

The alkali metal carbonate which can be present in the detergent composition according to the present invention may be a carbonate of sodium or potassium or a mixture of the sodium salt with the potassium salt. Among them, sodium carbonate is preferred in the present invention. Sodium carbonate is as described above.

Besides the above-described components, the powdery detergent composition of the present invention usually contains an optional component such as a detergent assistant, an additive and the like which is usually used in detergent compositions. Examples of the additive include inorganic electrolytes such as sodium sulfate, inorganic chelating agents such as sodium tripolyphosphate, organic chelating agents such as an aminopolyacetate and a polyacrylate, anti-redeposition agents such as carboxymethylcellulose, enzymes such as protease, lipase, cellulase and amylase, antioxidants, fluorescent dyes, blueing agents and perfumes. Further, the powdery detergent composition of the present invention may contain a surface modifier, e.g., calcium carbonate or the like, besides a crystalline aluminosilicate. When the detergent composition is used as a bleaching detergent composition, it is possible to incorporate a bleaching agent such as sodium percarbonate and sodium perborate mono- or tetrahydrate, a stabilizer for a peroxide such as magnesium silicate, a bleach activator, etc. Further, when the detergent composition is used as a softening detergent composition, it is possible to incorporate a cationic surfactant and, when an enhancement in the detergency against dirt is intended, it is possible to incorporate a small amount of an anionic surfactant or the like. As the optional component, a powder of a surface modifier, a perfume, an enzyme and the like are generally used.

The nonionic powdery detergent composition of the present invention has a bulk density of about 0.6 to 1.2 g/ml, preferably 0.7 to 0.9 g/ml.

The nonionic powdery detergent composition according to the present invention may be prepared by gradually adding or spraying the nonionic surfactant (a) onto a mixture of powdery components comprising the crystalline layer silicate (b) and the porous oil-absorbent carrier (c) under stirring to prepare a homogeneous mixture and, if necessary, mixing the homogeneous mixture with one or more of the optional components.

The nonionic powdery detergent composition according to the present invention may also be prepared by gradually adding or spraying the nonionic surfactant (a) onto a mixture of powdery components comprising the crystalline layer silicate (b) and the porous oil-absorbent carrier (c) under stirring to prepare a homogeneous mixture, adding the polyethylene glycol (d) in a molten state to the homogeneous mixture to prepare a base for the nonionic powdery detergent composition and, if necessary, mixing the base with one or more of optional components.

When the nonionic powdery detergent composition further contains a carbonate, the mixture of powdery components comprises the crystalline layer silicate (b), the porous oil-absorbent carrier (c) and the carbonate.

The nonionic powdery detergent composition of the present invention can be easily produced by gradually adding or spraying a liquid nonionic surfactant while mixing powdery components including the crystalline layer silicate, the porous oil-absorbent carrier and optionally the carbonate, etc., to prepare a homogeneous mixture and mixing the homogeneous mixture with minor components such as a perfume and an enzyme, a surface modifier and a bleaching agent when the composition is used as a bleaching detergent composition. When the particle diameter of the powdery detergent composition is large (200 to 1000 μm, preferably 300 to 700 μm), a further improvement in the properties of the detergent powder during storage for a long period of time can be attained.

EXAMPLES

The present invention will now be described in more detail with reference to the following Examples, though it is not limited to these Examples only.

Example 1

A batch kneader (Bench Kneader PNV-1 available from Irie Shokai Co., Ltd.) was charged with 3% by weight of a beef tallow soap, an oil-absorbent carrier (c) having properties given in Tables 1 and 2 and a crystalline layer sodium silicate (b) [Na-SKS-6 (manufactured by Hoechst); particle diameter: 50 to 150 μm; cation exchange capacity: 280 mg $CaCO_3$/g] in respective amounts specified in Tables 3 and 4, a balancing amount of sodium carbonate (average particle diameter: 200 μm), 3% by weight of sodium polyacrylate (average molecular weight: 7000) and 0.5% by weight of a fluorescent dye. A liquid nonionic surfactant (a) in an amount specified in Tables 3 or 4 was gradually fed into the kneader and then 2% by weight of a melt of a polyethylene glycol (d) having a weight average molecular weight of 12000 was added thereto to provide a base for a powdery detergent composition having an average particle diameter of 385 μm. Further, 0.5% by weight of an enzyme, 0.3% by weight of a perfume and 3% by weight of zeolite 4A were added to the base and mixed with the base to provide a final detergent product having the above-described composition (which were partially given in Tables 3 or 4).

The detergent product was subjected to a test on bleeding, a test on the solubility after a lapse of time and a test on the detergency against a fatty acid soil.

The results are given in Tables 3 and 4.

Evaluation Methods

1. Test on Bleeding

A box provided with no top sheathing and having a size of 10.2 cm in length×6.2 cm in width×4 cm in height was made of a coated carton (640 g/m$^2$), and four corners of the box was stapled. 100 g of a sample was placed in this box, and an acrylic resin plate (15 g) and a lead plate (250 g) (total weight: 265 g) were put on the sample. Then, the box was allowed to stand in a thermohygrostat at 30° C. and 80% RH for 7 days. The degree of bleeding on the coated carton after the test was judged based on the following criteria:

A: no bleeding observed on the internal surface of the box,

B: slight damping observed on the internal surface of the box,

C: damping observed on the whole internal surface of the box,

D: damping extended to part of the external surface of the box, and

E: damping extended to one-third or more of the external surface of the box.

2. Test on Solubility after a Lapse of Time

A powdery detergent product was placed in a Petri dish and allowed to stand at 30° C. and 50% RH for 3 days. 0.83 g of the powder was then sampled and added into 1 l of tap water at 10° C. The mixture was stirred by means of a magnetic stirrer for 10 min and filtered through a 200-mesh wire gauze, and solid matter remaining on the wire gauze was dried to determine the percentage filtration residue %.

3. Test on Detergency against a Fatty Acid Soil

Preparation of Artificially Soiled Fabric

An oily component containing fatty acids and paraffins according to the following formulation was mixed with carbon black in a ratio of 100 parts by weight of the former to 5 parts by weight of the latter, and 1 kg of the resultant mixture was dissolved and dispersed in 80 l of tetrachloroethylene to prepare a soiling medium. A shirting #2023 was immersed into the soiling medium to soil the cloth and dried to remove tetrachloroethylene. The resultant soiled cloth was cut into a size of 10 cm×10 cm and applied to an experiment.

Formulation of an oily component
oleic acid 20% by weight
palmitic acid 20% by weight
liquid and solid paraffin 60% by weight

Calculation of Percentage Cleaning

A nonsoiled fabric and artificially soiled fabrics before and after washing were subjected to the measurement of the reflectance at 550 nm with a self-recording colorimeter (manufactured by Shimadzu Seisakusho Ltd.), and the percentage cleaning (D %) was calculated according to the following equation:

$$D\ (\%)=\{(L_2-L_1)/(L_0-L_1)\}\times 100$$

wherein $L_0$ represents the reflectance of the nonsoiled fabric, $L_1$ represents the reflectance of the soiled fabric before washing, and $L_2$ represents the reflectance of the soiled fabric after washing.

Washing Method

Washing was conducted by means of a Terg-O-Tometer, 100 rpm) under the following conditions:

bath ratio: 1/60
water temp.: 35° C.
washing time: 15 min with calcium-hardened water
rinsing: 5 min with calcium-hardened water (use is made of running water)

hardness of water: 8° DH (calcium-hardened water) concentration of detergent product: 0.1% by weight.

TABLE 1

| Kind | pH of 5% dispersion | Oil absorbability (ml/100 g) | Silicon content as $SiO_2$ (wt. %) |
|---|---|---|---|
| Tokusil AL-1 ® (Tokuyama Soda Co., LTD.) | 9.2 | 255 | 94 |
| Nipsil NA ® (Nippon Silica Industrial Co., Ltd.) | 10.2 | 245 | 93 |
| Tixolex 25 ® (Kofran Chemical) | 9.8 | 235 | 72 |
| Carplex #100 ® (Shionogi Pharmaceutical Co., LTD.) | 10.4 | 230 | 93 |
| Sipernat D 10 ® (DEGUSSA) | 10.3 | 240 | 98 |
| Tokusil NR ® (Tokuyama Soda Co., Ltd.) | 5.8 | 280 | 94 |
| Florite RN ® (Tokuyama Soda Co., Ltd.) | 8.1 | 380 | 61 |
| Tixosil 38 ® (Kofran Chemical) | 6.5 | 280 | 90 |

TABLE 2

| Kind | Silicon content as $SiO_2$ (wt. %) | Oil absorbability (ml/100 g) | pH of 5% dispersion | Amt. of dissoln. in 100 ml of 2% aq. NaOH soln. (g) |
|---|---|---|---|---|
| Perlite (Dicalite, Perlite 4159, DICALITE ORIENT, Co., LTD.) | 72.7 | 165 | 7.8 | 0.01 |
| Na-Mordenite (HSZ-640NAA, Tosoh Corp.) | 87.5 | 110 | 10.7 | 0.12 |
| Tokusil NR (Tokuyama Soda Co., Ltd.) | 94 | 280 | 5.8 | 2.35 |
| Florite (Tokuyama Soda Co., Ltd.) | 61 | 380 | 8.1 | 2.18 |

Note

In the Tables 1 and 2, the pH value of the 5% dispersion and the oil absorbability are values measured according to JIS K 6220. The amount of dissolution in a 2% aqueous NaOH solution was measured by dispersing 10 g of the oil-absorbent carrier in 100 ml of a 2% aqueous NaOH solution, stirring the dispersion at a constant temperature of 25° C. for 16 hours, filtering and determining the $SiO_2$ content in the filtrate by colorimetry (Regarding the colorimetry, reference may be made to "Yukagaku", vol. 25, p. 158, 1976). Specifically, a calculation was conducted for the amount of dissolution of the oil-absorbent carrier in the aqueous NaOH solution converted from the $SiO_2$ content of the oil-absorbent carrier previously measured by elementary analysis.

TABLE 3

| | Composition (wt. %) | Product of invention | | | | | | | | | |
|---|---|---|---|---|---|---|---|---|---|---|---|
| | | 1 | 2 | 3 | 4 | 5 | 6 | 7 | 8 | 9 | 10 |
| component (a) | dodecyl alcohol ethoxylate ($E\bar{O}p$*1 = 8, m.p. 15° C.) | 24 | 24 | 24 | 24 | 24 | 24 | 24 | 24 | | 15 |
| | prim. synthetic alcohol ethoxylate ($C_{12-14}$* $E\bar{O}p$*1 = 10, m.p. 22° C.) | | | | | | | | | 20 | |
| component (b) | crystalline layer sodium silicate (powder form) | 30 | 30 | 30 | 30 | 30 | 30 | 30 | 30 | 45 | 55 |
| component (c) | Tokusil AL-1 ® | 10 | | | | | | | | 5 | |
| | Nipsil NA ® | | 10.5 | | | | | | | | |
| | Tixolex 25 ® | | | 10.5 | | | | | | | 10 |
| | Carplex #100 ® | | | | 11 | | | | | | |
| | Sipernat D10 ® | | | | | 10.5 | | | | | |
| | Tokusil NR ® | | | | | | 10 | | | | |
| | Florite RN ® | | | | | | | 10.5 | | | |
| | Tixosil 38 ® | | | | | | | | 10.5 | | |
| Results of evaluation | bleeding | A~B | A~B | A~B | A~B | A~B | A~B | A~B | A~B | A~B | A~B |
| | solubility after lapse of time (percentage filtration residue (%)) | 0.3 | 0.4 | 0.3 | 0.3 | 0.3 | 0.7 | 0.8 | 0.7 | 0.2 | 0.4 |
| | detergency against fatty acid soil (percentage cleaning (%)) | 70.1 | 70.0 | 71.1 | 70.6 | 71.0 | 70.2 | 70.4 | 71.1 | 72.2 | 70.0 |

*1: $E\bar{O}p$ represents the av. no. of moles of addn. of ethylene oxide

TABLE 4

| | Composition (wt. %) | Comp. product | | Product of invention | | Comp. product | | |
|---|---|---|---|---|---|---|---|---|
| | | 11 | 12 | 13 | 14 | 15 | 16 | 17 |
| component (a) | dodecyl alcohol ethoxylate ($E\bar{O}p$*1 = 8, m.p. 15° C.) | 15 | 24 | | | 20 | 20 | 10 |
| | synthetic alcohol ethoxylate ($C_{12-14}$* $E\bar{O}p$*1 = 7, m.p. 15° C.) | | | 24 | 24 | | | |
| component (b) | crystalline layer sodium silicate | 55 | | 30 | 30 | 50 | | 55 |

TABLE 4-continued

| | Composition (wt. %) | Comp. product 11 | Comp. product 12 | Product of invention 13 | Product of invention 14 | Product of invention 15 | Comp. product 16 | Comp. product 17 |
|---|---|---|---|---|---|---|---|---|
| | (powder form) | | | | | | | |
| | Zeolite 4A | | 30 | | | | 30 | |
| | sodium silicate (JIS No. 1 powder) | | | | | | 10 | |
| component (c) | Tokusil AL-1 ® | 3 | | | | | | |
| | Tixolex 25 ® | | 10.5 | | | | | |
| | Perlite ® | | | 20 | | 15 | 15 | |
| | Na-Mordenite | | | | 16 | | | |
| Results of evaluation | bleeding | B | A~B | A~B | A~B | A~B | A~B | B |
| | solubility after lapse of time (percentage filtration residue (%)) | 1.0 | 0.3 | 0.2 | 0.2 | 0.4 | 1.6 | 1.9 |
| | detergency against fatty acid soil (percentage cleaning (%)) | 70.1 | 67.9 | 70.7 | 70.6 | 71.2 | 70.6 | 64.9 |

*1: EOp̄ represents the av. no. of moles of addn. of ethylene oxide

Synthesis Example 1

Sodium carbonate was dissolved in deionized water to prepare an aqueous solution having a sodium carbonate concentration of 6% by weight, and a 1000-ml reaction vessel equipped with a baffle was charged with 132 g of the aqueous solution thus obtained and 38.28 g of an aqueous sodium aluminate solution having a water content of 50% by weight. A reaction was allowed to proceed at 40° C. over a period of 20 minutes under vigorous stirring while dropwise adding 201.4 g of an aqueous JIS No. 3 sodium silicate solution which was prepared by diluting JIS No. 3 sodium silicate with water twice as much as the sodium silicate. In this case, the reaction rate was optimized by blowing $CO_2$ gas into the system to adjust the pH value (pH: 10.5) of the reaction system. After the completion of the reaction, the system was heated to 50° C. and aged for 30 minutes. Thereafter, $CO_2$ gas was blown into the system to neutralize excess alkali (pH: 9.0). The neutralized slurry thus obtained was filtered through a filtration paper (No. 5C manufactured by Toyo Roshi Co., Ltd.) under reduced pressure. The cake recovered by the filtration was washed with water 1000 times as much as the cake and filtered, and the resultant cake was dried (at 105° C. under a pressure of 300 Torr for 10 hours). The dried cake was disintegrated to provide an amorphous aluminosilicate powder.

As results of atomic absorption spectrophotometry and plasma emission spectrochemical analysis which exhibited measured values with respect to the amorphous aluminosilicate powder as an anhydride, the obtained powder was found to comprise 29.6% by weight of $Al_2O_3$, 52.4% by weight of $SiO_2$ and 18.0% by weight of $Na_2O$ (1.0 $Na_2O.Al_2O_3.3.01$ $SiO_2$). The Ca ion scavenging capacity and oil absorbability thereof were 165 mg $CaCO_3$/g and 285 ml/100 g, respectively.

A 5% dispersion of the powder had a pH value of 10.2, and the solubility of the powder in 100 ml of a 2 wt. % aqueous NaOH solution was 0.10 g.

Synthesis Example 2

A 1000-ml reaction vessel equipped with a baffle was charged with 55 g of a 6% by weight aqueous sodium carbonate solution prepared in Synthesis Example 1, 51.04 g of an aqueous sodium aluminate solution having a water content of 50% by weight and 25 g of ethanol, and a reaction was allowed to proceed at 40° C. over a period of 20 minutes under vigorous stirring while dropwise adding 268.5 g of an aqueous JIS No. 3 sodium silicate solution which was prepared by diluting JIS No. 3 sodium silicate with water twice as much as the sodium silicate and 0.5 g of calcium chloride dihydrate. The pH value was adjusted to 11 with citric acid throughout the reaction. After the completion of the reaction, the system was aged at 40° C. for 30 minutes. Thereafter, $CO_2$ gas was blown into the system to neutralize excess alkali (pH: 9.8). The neutralized slurry thus otained was filtered, washed, dried and disintegrated in the same manner as that of Synthesis Example 1 to provide an amorphous aluminosilicate powder.

As a result of atomic absorption spectro-photometry and plasma emission spectrochemical analysis, the obtained powder was found to comprise 29.3% by weight of $Al_2O_3$, 52.2% by weight of $SiO_2$, 17.7% by weight of $Na_2O$ and 0.8% by weight of CaO (0.99 $Na_2O{\cdot}0.05$ $CaO{\cdot}Al_2O_3{\cdot}3.03$ $SiO_2$). The Ca ion scavenging capacity and oil absorbability thereof were 164 mg $CaCO_3$/g and 310 ml/100 g, respectively.

A 5% dispersion of the powder had a pH value of 10.3, and the solubility of the powder in 100 ml of a 2 wt. % aqueous NaOH solution was 0.07 g.

Example 2

An agitation tumbling granulator (a Lödige mixer) was charged with 3% by weight of a sodium salt of a beef tallow fatty acid, a crystalline layer sodium silicate (b) [Na-SKS-6 (manufactured by Hoechst); particle diameter: 50 to 150 μm; cation exchange capacity: 280 mg $CaCO_3$/g], the amorphous alumino-silicate (c') produced in Synthesis Examples 1 or 2, a zeolite (e) and a salt in respective amounts specified in Table 5 and 0.5% by weight of a fluorescent dye. A liquid nonionic surfactant (a) [a synthetic alcohol ($C_{12-14}$) ethoxylate having a melting point of 15° C., an average number of moles of added ethylene oxide of 7 and a number of carbon atoms of alcohol of 12 to 14] in an amount specified in Table 5 was gradually introduced into the mixer, and then 2% by weight of a melt of a polyethylene glycol (d) having a weight average molecular weight of 8000 and further 0.5% by weight of an enzyme (0.3% by weight of protease and 0.2% by weight of cellulase), 0.5% by weight of a perfume and 2% by weight of water were added thereto and mixed with each other to provide a detergent product having the composition given in Table 5.

The detergent product was subjected to a test on bleeding, a test on the solubility after a lapse of time and a test on the detergency against a fatty acid soil in the same manner as that of Example 1.

The results are given in Table 5.

TABLE 5

| | Composition (wt. %) | | Product of invention 18 | 19 | 20 | 21 | 22 | 23 | Comp. product 24 |
|---|---|---|---|---|---|---|---|---|---|
| component (a) | synthetic alcohol ($C_{12-14}$) ethoxylate ($EO\bar{p}$*1 = 7, m.p. 15° C.) | | 20 | 30 | 30 | 45 | 20 | 20 | 35 |
| component (b) | crystalline layer sodium silicate | | 25 | 20 | 17.5 | 10 | 15 | 24.5 | 2 |
| component (c') | amorphous aluminosilicate | Synthesis Ex. 1 | 17.5 | 16.5 | | | | 12.0 | 16.5 |
| | | Synthesis Ex. 2 | | | 14.0 | 16.0 | 7.5 | | |
| Salt | sodium carbonate (av. particle diam.: 350 nm) JIS No. 2 sodium silicate*2 | | 12 | 10 | 10 | 8 | 27 | 20 | 12 |
| | | | | | | | 2 | | |
| Other components | | | 8.5 | 8.5 | 8.5 | 8.5 | 8.5 | 8.5 | 8.5 |
| Results of evaluation | bleeding | | A~B | A~B | A~B | A~B | A~B | A~B | A~B |
| | solubility. after lapse of time (percentage filtration residue (%)) | | 0.5 | 0.2 | 0.3 | 0.2 | 1.0 | 0.7 | 0.2 |
| | detergency against fatty acid soil (percentage cleaning (%)) | | 71.6 | 70.9 | 71.2 | 70.2 | 70.7 | 69.4 | 62.8 |

*1: $EO\bar{p}$ represents the av. no. of moles of addn. of ethylene oxide
*2: $Na_2O.2.5\ SiO_2$ (manufactured by The Nippon Chemical Industrial Co., Ltd.)

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A nonionic powdery detergent composition having a bulk density of 0.6 to 1.2 g/cm$^3$ and having an average particle diameter of 200 to 1000 um comprising 12 to 50% by weight, based on the total weight of the composition, of (a) a nonionic surfactant having a melting point of 40° C. or below, 3 to 60% by weight, based on the total weight of the composition, of (b) a crystalline layer silicate represented by the formula (I) and 5 to 30% by weight, based on the total weight of the composition, of (c) a porous oil-absorbent carrier having an oil absorbability of 80 ml/100 g or more and wherein said carrier is an amorphous silica:

$$M_2Si_xO_{(2x+1)}\cdot y(H_2O) \quad (I)$$

wherein M represents an alkali metal atom and x and y are respectively $1.5 \leqq x \leqq 4$ and $y \leqq 25$.

2. The nonionic powdery detergent composition according to claim 1, wherein the porous oil-absorbent carrier (c) is one containing silicon in an amount of 30% by weight or more of $SiO_2$ based on the entire porous oil-absorbent carrier, as determined with no hydrate present.

3. The nonionic powdery detergent composition according to claim 1, wherein the porous oil-absorbent carrier (c) is one which satisfies the requirement that a 5% dispersion of the porous oil-absorbent carrier in water has a pH value of 9 or greater or the requirement that the amount of dissolution of the porous oil-absorbent carrier in 100 ml of a 2% aqueous NaOH solution is 0.5 g or less.

4. The nonionic powdery detergent composition according to claim 1, wherein the nonionic surfactant (a) is a polyoxyethylene alkyl ether wherein the alkyl group has 10 to 20 carbon atoms and the average number of moles of addition of ethylene oxide is 5 to 15.

5. A process for producing a nonionic powdery detergent composition having a bulk density of 0.6 to 1.2 g/cm$^3$ and having an average particle diameter of 200 to 1000 um which comprises gradually adding or spraying under stirring 12 to 50% by weight based on the total weight of the composition of (a) a nonionic surfactant having a melting point of 40° C. or below onto a mixture of powdery components comprising 10 to 60% by weight based on the total weight of the composition of (b) a crystalline layer silicate represented by the following formula (I) and 5 to 30% by weight based on the total weight of the composition of (c) a porous oil-absorbent carrier having an oil absorbability of 80 ml/100 g or more, and containing silicon, calculated as $SiO_2$, in an amount of 30% by weight or more based on the entire porous oil-absorbent carrier, as determined with no hydrate present, and satisfying the requirement that a 5% dispersion of the porous oil-absorbent carrier in water has a pH value of 9 or greater, or the requirement that the amount of dissolution of the porous oil-absorbent carrier in 100 ml of a 2% aqueous NaOH solution is 0.5 g or less and wherein said porous oil-absorbing carrier is an amorphous silica to produce a homogeneous mixture:

$$M_2Si_xO_{(2x+1)}\cdot Y(H_2O) \quad (I)$$

wherein M represents an alkali metal atom and x and y are respectively $1.5 \leqq x \leqq 4$ and $y \leqq 25$.

6. The process for producing a nonionic powdery detergent composition according to claim 5, wherein the nonionic powdery detergent composition further contains a carbonate and the mixture of powdery components comprises the crystalline layer silicate (b), the porous oil-absorbent carrier (c) and the carbonate.

7. The process for producing a nonionic powdery detergent composition according to claim 5, which further comprises mixing the homogeneous mixture with a detergent assistant or an additive selected from the group consisting of inorganic electrolytes, inorganic chelating agents, organic chelating agents, antiredeposition agents, fluorescent dyes and blueing agents.

8. The process for producing a nonionic powdery detergent composition according to claim 5, which further comprises at least one member selected from the group consisting of a surface modifier, a perfume and an enzyme.

9. A process for producing a nonionic powdery detergent composition having a bulk density of 0.6 to 1.2 g/cm$^3$ and having an average particle diameter of 200 to 1000 um which comprises gradually adding or spraying under stirring 12 to 50% by weight based on the total weight of the composition of (a) a nonionic surfactant having a melting point of 40° C. or below onto a mixture of powdery components comprising 10 to 60% by weight based on the total weight of the composition of (b) a crystalline layer silicate represented by the formula (I) and 5 to 30% by weight based on the total weight of the composition of (c) a porous oil-absorbent carrier having an oil absorbability of 80 ml/100 g or more to produce a homogeneous mixture and wherein the porous oil absorbent carrier is an amorphous silica, and then adding 0 to 5% by weight based on the total weight of the composition of (d) a polyethylene glycol having a weight average molecular weight of 4000 to 20000 in a molten state to the homogeneous mixture to produce a base for the nonionic powdery detergent composition:

$$M_2Si_xO_{(2x+1)}\cdot Y(H_2O) \quad (I)$$

wherein M represents an alkali metal atom and x and y are respectively $1.5 \leqq x \leqq 4$ and $y \leqq 25$.

10. The process for producing a nonionic powdery detergent composition according to claim 9, wherein the nonionic surfactant (a) is a polyoxyethylene alkyl ether wherein the alkyl group has 10 to 20 carbon atoms and the average number of moles of addition of ethylene oxide is 5 to 15.

11. The process for producing a nonionic powdery detergent composition according to claim 9, wherein the nonionic powdery detergent composition further contains a carbonate and the mixture of powdery components comprises the crystalline layer silicate (b), the porous oil-absorbent carrier (c) and the carbonate.

12. The process for producing a nonionic powdery detergent composition according to claim 9, which further comprises mixing the homogenous mixture with a detergent assistant or an additive selected from the group consisting of inorganic electrolytes, inorganic chelating agents, organic chelating agents, antideposition agents, fluorescent dyes and blueing agents.

13. The process for producing a nonionic powdery detergent composition according to claim 9, which further comprises at least one member selected from the group consisting of a surface modifier, a perfume and an enzyme.

14. A nonionic powdery detergent composition having a bulk density of 0.6 to 1.2 g/cm$^3$ and having an average particle size of 200 to 1000 um consisting essentially of components (a) to (d):

(a) a nonionic surfactant having a melting point of 40° C. or below in an amount of 12 to 50% by weight based on the total weight of the composition;

(b) a crystalline layer silicate represented by the formula (I) in an amount of 10 to 60% by weight based on the total weight of the composition:

$$M_2Si_xO_{(2x+1)}\cdot Y(H_2O) \quad (I)$$

wherein M represents an alkali metal atom and x and y are respectively $1.5 \leqq x \leqq 4$ and $y \leqq 25$;

(c) a porous oil-absorbent carrier in an amount of 5 to 30% by weight based on the total weight of the composition, having an oil absorbability of 80 ml/100 g or more, and containing silicon, calculated as $SiO_2$, in an amount of 30% by weight or more based on the entire porous oil-absorbent carrier, as determined with no hydrate present, and satisfying the requirement that a 5% dispersion of the porous oil-absorbent carrier in water has a pH value of 9 or greater, or the requirement that the amount of dissolution of the porous oil-absorbent carrier in 100 ml of a 2% aqueous NaOH solution is 0.5 g or less and wherein said porous oil-absorbing carrier is an amorphous silica; and (d) a polyethylene glycol in an amount of 0 to 5% by weight based on the total weight of the composition.

15. The nonionic powdery detergent composition of claim 14, further comprising a soap.

16. The nonionic powdery detergent composition according to claim 14, wherein the nonionic surfactant (a) is a polyoxyethylene alkyl ether wherein the alkyl group has 10 to 20 carbon atoms and the average number of moles of addition of ethylene oxide is 5 to 15.

17. The powdery detergent composition according to claim 14, wherein the composition essentially consists of (a), (b) and (c).

18. The nonionic powdery detergent composition according to claim 14, wherein the amount of the polyethylene glycol (d) is 1 to 5% by weight based on the total weight of the composition.

* * * * *